United States Patent [19]

Arsenault

[11] 4,019,542

[45] Apr. 26, 1977

[54] LUG STRAP

[75] Inventor: Joseph A. Arsenault, Concord, N.H.

[73] Assignee: Page Belting Company Incorporated, Concord, N.H.

[22] Filed: Feb. 6, 1976

[21] Appl. No.: 655,776

[52] U.S. Cl. ..... 139/153

[51] Int. Cl.[2] ..... D03D 49/40

[58] Field of Search ..... 139/153, 154, 151, 161 S, 139/164

[56] References Cited

UNITED STATES PATENTS

| | | | |
|---|---|---|---|
| 574,204 | 12/1896 | Livsey | 139/153 |
| 2,212,577 | 8/1940 | Webster | 139/153 |
| 3,900,052 | 8/1975 | Benedict et al. | 139/153 |

FOREIGN PATENTS OR APPLICATIONS

| | | | |
|---|---|---|---|
| 69,052 | 6/1915 | Germany | 139/153 |
| 978,052 | 12/1964 | United Kingdom | 139/153 |
| 813,874 | 5/1959 | United Kingdom | 139/153 |

*Primary Examiner*—James Kee Chi

*Attorney, Agent, or Firm*—Norman S. Blodgett; Gerry A. Blodgett

[57] ABSTRACT

Lug strap consisting of a bight joining two parallel elongated legs the bight consisting of a central portion having an inner surface which is substantially at a right angle to the direction of the legs and is joined at its ends to the legs by transition portions.

4 Claims, 13 Drawing Figures

VIII
VIII
10
15
16
17
18
19
21
22
23
24
25
26

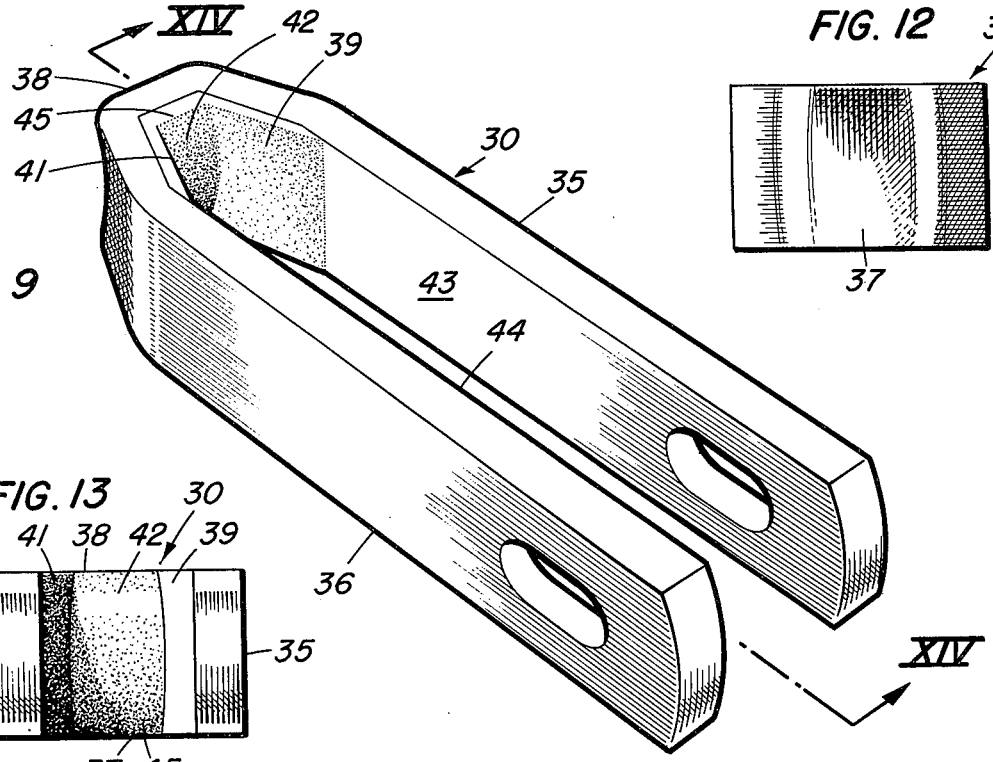
FIG. 9
FIG. 12
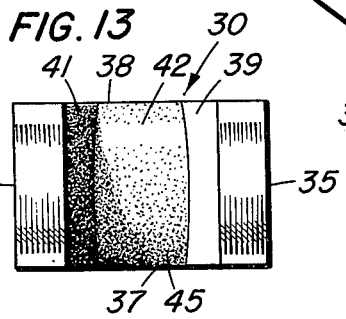
FIG. 13
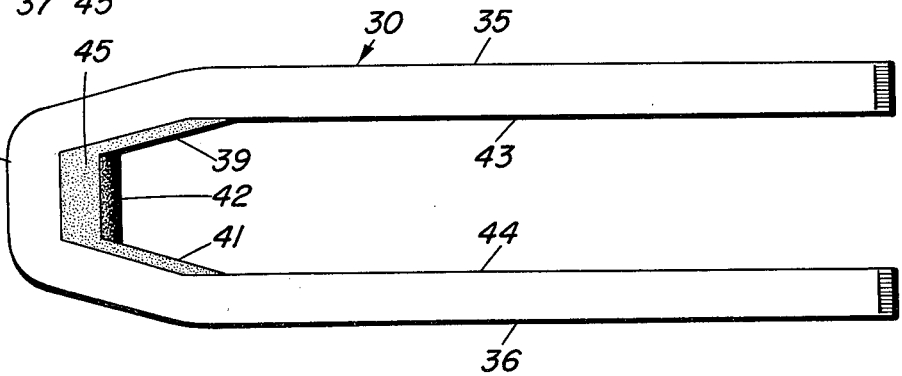
FIG. 10
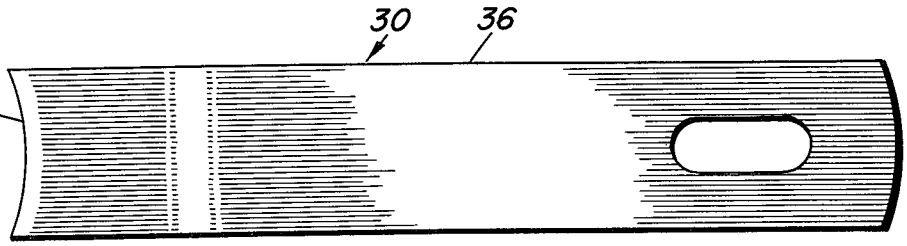
FIG. 11
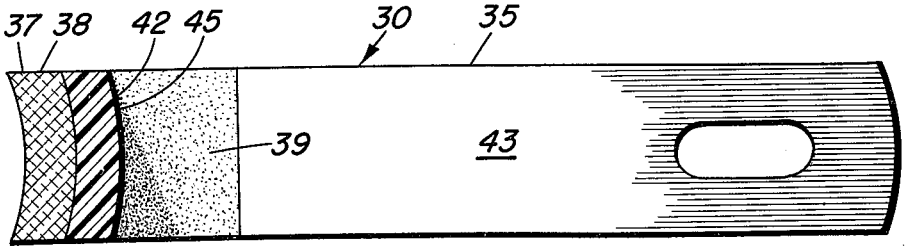
FIG. 14

LUG STRAP

BACKGROUND OF THE INVENTION

In the operation of a loom having a shuttle which is moved back and forth by hinged picker sticks, it is common practice to swing each picker stick by means of a reciprocating mechanism which is connected to the picker stick by a U-shaped lug strap. The picker stick engages the bight of the strap and the legs of the strap are attached to the reciprocating mechanism. During the operation of the loom at a high rate of speed, a large number of forces acting in various directions are received and absorbed by the lug strap, so that the lug strap is a portion of the loom that falls into a state of disrepair more often than other parts. Shutting down the loom to provide it with a new lug strap is an economic waste, not to speak of the expense of the millwright's time in making the changeover. In other words, not only is an expense involved when it is necessary to provide new lug straps at frequent intervals, but the downtime and labor involved are also appreciable. For that reason, a considerable amount of experimental work has been done to develop the ideal lug strap. The lug straps in the older looms were made of leather and, at slow pick speeds, this material has many advantages. One advantage is that (at least at one time) it was fairly inexpensive. As pick speeds increased over the years, due to the development and improvements in other parts of the loom, it was found necessary to manufacture lug straps of a more sophisticated nature. One fruitful line of investigation involved the use of woven webbing as a material for the lug strap; this material had the advantage of being able to absorb and deaden shock forces and vibrations. With the development of modern polymeric materials, certain advantages have been obtained in impregnating the fiber of the webbing with polymers.

While the impregnation of the webbing with a polymer reduces the wear and prolongs the life of the strap, other difficulties have arisen. For one thing, it has always been the practice to form the bight of the lug strap in a semi-circular form. It has been found that, when impregnated webbing is used in this shape for the lug strap, the striking of the arc by the picker stick (which is generally rectangular cross-sectional form) results in extreme distortion of the shape of the shape. This not only causes a change in the length of the strap (and therefore of the adjustment of the loom), but also causes certain actions that tend to destroy the strength of the lug strap. More specifically, the encounter of the sharp corners of the rectangular picker stick with the curved surface of the lug strap produces a high concentration of force. These and other difficulties experienced with the prior art devices have been obviated in a novel manner by the present invention.

It is, therefore, an outstanding object of the invention to provide a lug strap for a loom, which strap retains its dimensional integrity throughout a long life of service.

Another object of this invention is the provision of a lug strap which does not require adjustment or replacement for long periods of time.

A further object of the present invention is the provision of a lug strap which wears very little under the action of the picker stick and which makes relatively little noise.

It is another object of the instant invention to provide a lug strap which can be readily manufactured from inexpensive, readily-available materials and which is capable of a long life of useful service with a minimum of maintenance.

With these and other objects in view, as will be apparent to those skilled in the art, the invention resides in the combination of parts set forth in the specification and covered by the claims appended hereto.

SUMMARY OF THE INVENTION

In general, the invention consists of a lug strap for use with a picker stick in a loom, the strap having two parallel elongated legs and a bight joining the adjacent ends of the legs. The legs and bight are formed of a webbing of woven fibers of a first polymer, the webbing being impregnated with a second polymer. The bight is formed with a central portion extending perpendicular to the general longitudinal direction of the legs and has two transition portions each leading angularly from the end of one leg to the adjacent end of the central portion.

More specifically, the central portion has an inner surface that is curved in cross-sections taken parallel to the inner surfaces of the legs. The bight is formed by the application of heat and pressure after the webbing has been impregnated with the second polymer and before it is completely polymerized. The first polymer is nylon and the second polymer is polyurethane.

BRIEF DESCRIPTION OF THE DRAWINGS

The character of the invention, however, may be best understood by reference to one of its structural forms, as illustrated by the accompanying drawings, in which:

FIG. 9 is a perspective view of a modified form of the lug strap, FIG. 10 is a front elevational view of the lug strap of FIG. 9, FIG. 11 is a plan view of the lug strap of FIG. 9, FIG. 12 is an end elevational view of the lug strap of FIG. 9, FIG. 13 is another end elevational view of the lug strap of FIG. 9, and FIG. 14 is a vertical sectional view of the lug strap taken on the line of XIV—XIV of FIG. 9.

DESCRIPTION OF THE PREFERRED EMBODIMENT

Figure 1:
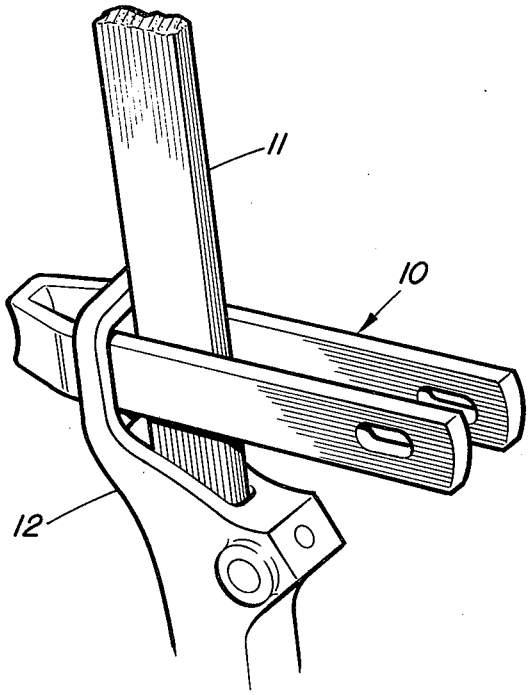
FIG. 1 is a perspective view of a lug strap embodying the principles of the present invention shown in use in a loom.

FIG. 1 shows a lug strap 10 constructed in accordance with the invention shown in use with a picker stick 11 and associated with a guide bracket 12. Free ends of the lug strap are attached to a reciprocating mechanism for actuating the picker stick.

Figure 2:
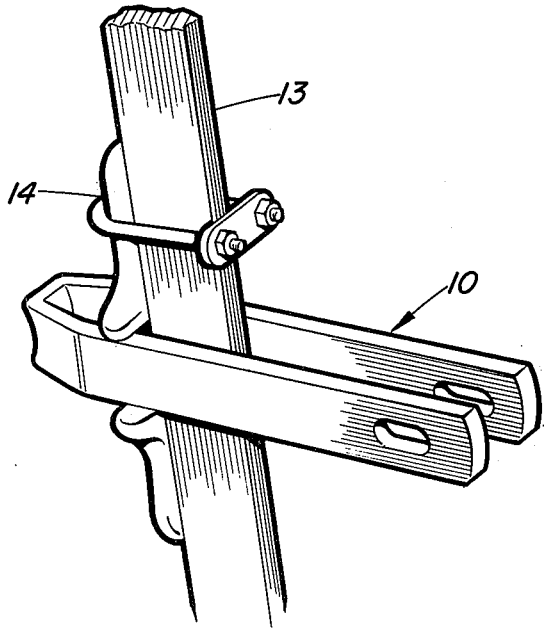
FIG. 2 is a perspective view of the lug strap as used in another type of loom.

FIG. 2 shows a similar perspective view of the lug strap 10 being used in another type of loom having a picker stick 13 on which is carried a guide 14.

Figures 3, 4, 5, 6, 7, 8:
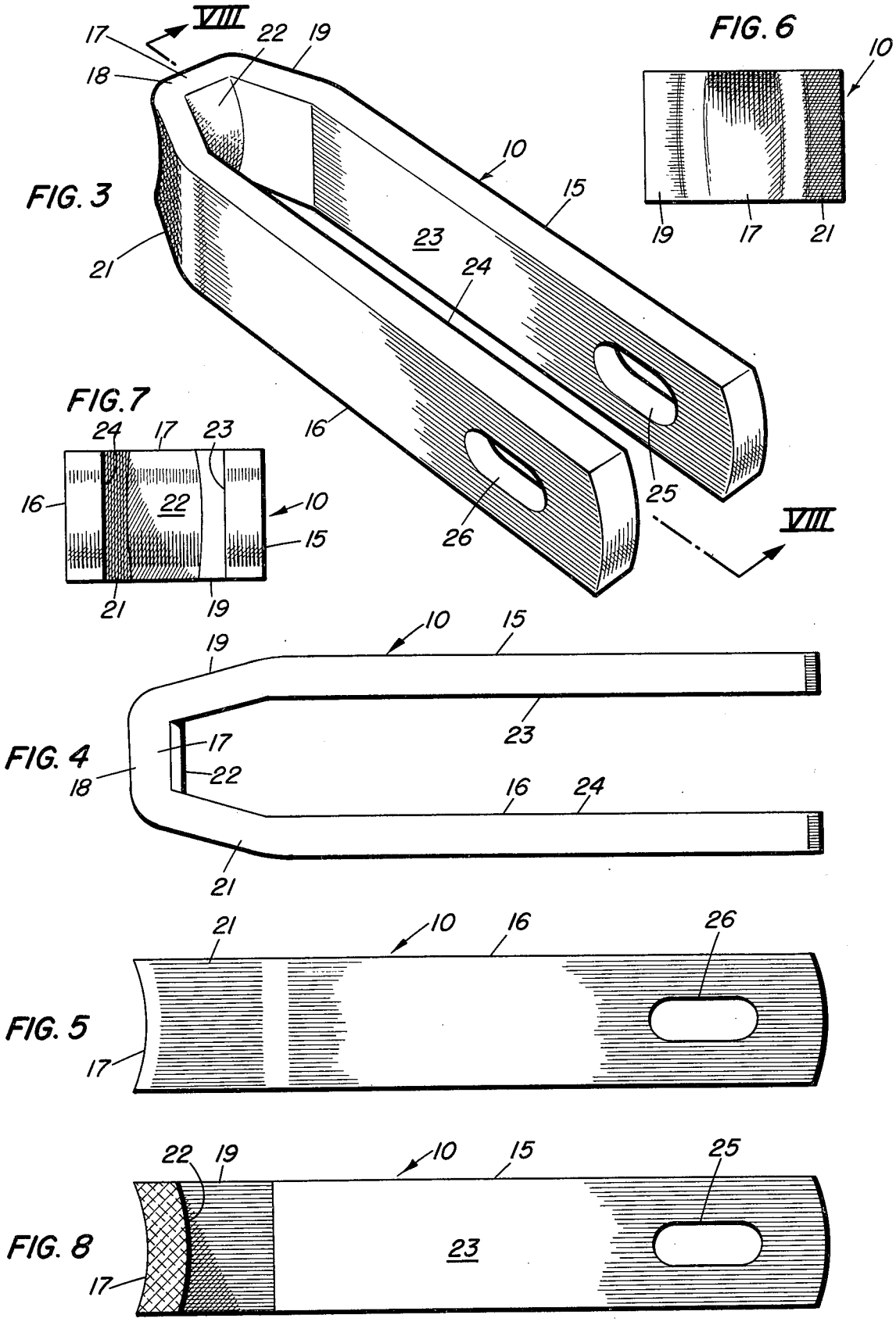
FIG. 3 is a somewhat enlarged perspective view of the lug strap.
FIG. 4 is a plan view of the lug strap.
FIG. 5 is a side elevational view of the lug strap.
FIG. 6 is an end elevational view of the lug strap.
FIG. 7 is an elevational view taken from the other end of the lug strap.
FIG. 8 is a vertical sectional view of the lug strap taken on the line VIII—VIII of FIG. 3.

Referring next to FIG. 3, which best shows the general features of the invention, the lug strap 10 is shown as having two parallel elongated legs 15 and 16 joined by a bight 17 which joins adjacent ends of the legs. The legs and bight are formed of a webbing of woven fibers of a first polymer, such as nylon. The webbing is impregnated with a second polymer, such as polyurethane, in some locations, as will be more fully described hereinafter. The bight 17 is formed with a central portion 18 that extends perpendicular to the longitudinal direction of the legs 15 and 16 with two angularly-extending transition portions 19 and 21 leading, respectively, from the leg 15 to the adjacent end of the central portion and from the leg 16 to the adjacent end of the central portion.

The central portion 18 has an inner surface 22 that is curved in cross-sectional planes parallel to the inner surfaces of the legs. The bight is formed by the application of heat and pressure after the webbing has been impregnated with the second polymer and before it is completely polymerized. The webbing consists of three layers stitched together, each layer being formed as a three-ply nylon webbing. In the preferred embodiment of the invention, the first polymer described above is nylon and the second polymer is polyurethane. Suitable elongated apertures 25 and 26 are provided at the outer ends of the legs 15 and 16, respectively.

The nature of the surface 22 can be readily seen in FIG. 8. It is generally cylindrical with an axis that extends transversely of the apparatus with a radius of curvature substantially greater than the transverse length of the cylindrical surface.

The operation of the apparatus will now be readily understood in view of the above description. Irrespective of whether the lug strap 10 is used with the type of picker stick apparatus shown in FIG. 1 or the type of apparatus shown in FIG. 2, eventually the bight of the lug strap approaches the picker stick at high speed and the surface 22 approaches the surface of the stick. Since the stick lies at a substantial angle to the plane of the lug strap (and, therefore, engages the surface 22 above its centerline), the curvature of the surface compensates for this angularity of engagement and removes any possibility of any extraordinarily hard engagement between the stick and the surface 22 with the added noise and wear that would be caused by such an irregularity. By selecting the polyurethane with which the central portion is impregnated of a suitable durometer, it will be hard enough to resist wear from the stick, while at the same time having sufficient elasticity to avoid a noisy operation. In other words, while it might be assumed that the use of a curved surface 22 would cause substantial wear of the lug strap, it has been found by experience that the excellent wear characteristics of the polyurethane allows the type of engagement between the stick and the lug strap that is used in the present invention. While the curved surface compensates for irregularities in the physical relationship between the stick and the lug strap at the time that engagement is made, the wear that would normally be expected on the inner surface 22 is obviated by the selection of a proper material.

The advantages of the present invention will now be clearly understood. By constructing the device in the manner described, it is possible to obtain a lug strap which will give an extremely long life without at the same time introducing a high level of noise into the weaving room. The problem in the past has been that the selection of a long wearing material also resulted in a higher level of noise. The present movement toward a low noise level in any manufacturing operation (prompted largely by OSHA) has caused the tendency for loom operators to move away from the long wearing materials because they introduce so much more noise. With the present invention, however, a long wearing material is used but, because of the present invention, the noise is less than with a solid plastic strip.

FIGS. 9–14 show a modified form of the invention. The lug strap 30 is shown as having two parallel elongated legs 35 and 36 joined by a bight 37 which joins the adjacent ends of the legs. As in the other version of the lug strap, the legs and bight are formed of a webbing of woven fibers of a first polymer, the webbing being impregnated with a second polymer.

The bight 37 is formed with a central portion 38 which extends generally perpendicular to the longitudinal direction of the legs and of two transition portions 39 and 41 each leading angularly from the end of one leg to the adjacent end of the central portion.

The central portion 38 has an inner surface 42 that is curved in planes parallel to the inner surfaces of the legs 43 and 44. In other words, the surface is cylindrical with its general axis transversely of the lug.

A pad 45 of solid polyurethane is attached to the inner surfaces of the central portion 38 and the transition portions 39 and 41. The inner surface of the pad 45 forms the curved inner surface 45 described above, a portion of the pad 45 overlying the transition portions tapering to a point where the transition portions join their respective legs. As has been described above, the central portion 38 with the pad 45 is formed by the application of heat after the webbing has been impregnated with the urethane and the pad 45 formed before the polymer is polymerized. In the preferred embodiment, the webbing consists of three layers stitched together, each layer being formed as three-ply nylon webbing. The polymer used in the webbing is nylon and the second polymer with which it is impregnated is polyurethane. As is evident in the drawings, the pad 45 is of even thickness across the central portion, but tapers on each transition portion from a thicker inner end adjacent the center portion to a thinner outer end. Suitable apertures are provided at the ends of the legs.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Lug strap for use with a picker stick, comprising
   a. two parallel elongated legs,
   b. a bight being formed of a webbing of woven fibers of nylon the webbing being impregnated with polyurethane, the bight being formed with a central portion extending perpendicular to the longitudinal direction of the legs and with two transition portions each leading angularly from the end of one leg to the adjacent end of the central portion, the central portion having an inner surface that is curved in planes parallel to the inner sufaces of the legs, and c. a pad of solid urethane located on the inner surfaces of the central portion and the transition portions.

2. Lug strap as recited in claim 1, wherein the bight is formed by the application of heat and pressure after the webbing has been impregnated with the polyurethane and before it is completely polymerized.

3. Lug strap as recited in claim 1, wherein the webbing consists of three layers stitched together, each layer being formed as 3-ply nylon webbing.

4. Lug strap as recited in claim 1, wherein the pad is of even thickness across the central portion, but tapers on each transition portion from a thicker inner end adjacent the central portion to a thinner outer end.

* * * * *